350-3.6 SR
XR 4,029,507

United Stat
Wehner et al.

[11] 4,029,507
[45] June 14, 1977

[54] PROCESS FOR THE PRODUCTION OF LIGHTFAST PHASE HOLOGRAMS UTILIZING AMMONIUM DICHROMATE AND GELATIN AS PHOTOSENSITIVE RECORDING MATERIAL

[75] Inventors: Hans Wehner, Bergisch-Gladbach; Manfred Kliemann, Leichlingen, both of Germany

[73] Assignee: AGFA-Gevaert, A.G., Leverkusen, Germany

[22] Filed: Aug. 1, 1974

[21] Appl. No.: 493,515

[30] Foreign Application Priority Data

Aug. 4, 1973 Germany ..... 2339579

[52] U.S. Cl. ..... 96/49; 96/27 H; 350/3.5
[51] Int. Cl.[2] ..... G03C 5/22
[58] Field of Search ..... 96/49.27 H, 60 R, 61 R, 96/111; 350/3.5

[56] References Cited

UNITED STATES PATENTS

| | | | |
|---|---|---|---|
| 3,567,444 | 3/1971 | Shankoff | 96/27 H |
| 3,617,274 | 11/1971 | Lin | 96/75 |
| 3,660,090 | 5/1972 | Curran | 96/49 |
| 3,660,091 | 5/1972 | Shankoff et al. | 96/49 |
| 3,695,879 | 10/1972 | Laming et al. | 96/27 H |
| 3,728,118 | 4/1973 | Fillmore et al. | 96/49 |

OTHER PUBLICATIONS

Remy, H., "Treatise on Inorganic Chemistry", vol. 1, Elsevier Pub. Co., 1956, pp. 718–720.
Fillmore, G. L. et al., "Journal of the Opt. Soc. of Am.", vol. 61, No. 2, Feb. 1971, pp. 199–203.
Lin, L. H., "Applied Optics", vol. 8, No. 5, May 1969, pp. 963–966.
Megerhoff, D., "Applied Optics", vol. 10, No. 2, Feb. 1971, pp. 416–421.
Pennington, K. S. et al., "Applied Physics Letters", Feb. 1971, pp. 80–84, vol. 18, No. 13.
Shankoff, T. A., "Applied Optics", Oct. 1968, vol. 7, No. 10, pp. 2101–2105.
Fieser & Fieser, "Organic Chemistry", 1956, p. 198.
Mason, L. F. A., "Photographic Processing Chemistry", 1966, pp. 151–152.

*Primary Examiner*—Charles L. Bowers, Jr.
*Attorney, Agent, or Firm*—Connolly and Hutz

[57] ABSTRACT

Hardenable gelatine recording materials are used in a process for the production of lightfast phase halograms. The recording material is hardened by the exposure to light and sensitized with ammonium dichromate. After exposure, it is developed, dehydrated and hardened. Development is carried out in a desensitizing bath containing formaldehyde sulphite and is followed by hardening in a formalin solution. Dehydration is carried out in two successive stages. In the first stage, the material is treated with an aqueous isopropanol solution and in the second stage with a concentrated isopropanol solution to which formaldehyde is added.

7 Claims, No Drawings

PROCESS FOR THE PRODUCTION OF LIGHTFAST PHASE HOLOGRAMS UTILIZING AMMONIUM DICHROMATE AND GELATIN AS PHOTOSENSITIVE RECORDING MATERIAL

This invention relates to a process for the production of lightfast phase holograms, using hardenable gelatine as recording material. For this process, the recording material is hardened and sensitized with ammonium dichromate before it is exposed to light, and after, exposure, it is developed, dehydrated and hardened. Dichromate gelatine photolayers (hereinafter referred to as DIG Photolayers) in particular are used as recording material.

As is well known, phase holograms are produced directly by the holographic exposure of layers which are cross-linked by light, such as DIG layers, for example.

The formation of phase holograms in dichromate gelatine is based on the fact that, after holographic exposure, the tendency of the gelatine to swell is reduced in the exposed areas as a result of cross-linking. In order to obtain the highest possible differences in refractive index between the hologram structure and the unexposed areas of the layer, the layers are irrigated after exposure to light and rapidly dehydrated with alcohol.

Methods of sensitizing and processing DIG have been given in the literature by L. H. Lin Appl. Opt., Vol. 8, No. 5, 963–966 (May 69) and by R. G. Brandes, E. E. Francois, and T. A. Shankoff Appli. Opt Vol. 8, No. 11, 2346–2348 (Nov. 69). The methods of processing generally comprise a preliminary hardening of the gelatine, sensitization of the gelatine and exposure followed by development and dehydration and drying of the gelatine layer.

Lin generally uses known preliminary hardeners (without giving exact details) for protecting the gelatine against being washed out.

Brandes, Francois and Shankhoff use a 0.5% ammonium dichromate solution for hardening. The same material is also used for sensitizing, so that the prehardened plates are already sensitive to light and the preliminary degrees of hardening therefore cannot be adapted to the type of gelatine used. According to our investigations, adjustment to the predetermined, reproducible degree of preliminary hardening is important for the sensitivity to light and subsequent processing.

Since it is very difficult always to obtain the same quality of gelatine, these methods of preliminary hardening appear to be unsuitable. Sensitization of the layers is carried out in known manner by bathing them in 1 to 10% aqueous ammonium dichromate solution.

Exposure of the plates is followed by development and desensitization of the DIG layers. For this purpose, Lin irrigates the plates for 5 minutes at 20° C, and Brandes, Francois and Shankoff for 1 minute only at 25° to 40° C.

In our experience, it is impossible to achieve stable storage of information in DIG. layers by development with water because the light sensitive sensitizer ammonium dichromate cannot be washed out in 5 minutes, while longer irrigation times destroy the cross-linking produced by exposure to light. The subsequent rapid dehydration is carried out by both Lin and Brandes, Francois and Shankhoff is an isopropanol bath followed by drying in air. This causes the gelatine which has been dissolved by irrigation to precipitate, thereby producing a milky white fog. This fog considerably impairs the quality of the phase hologram. To prevent this effect, Lin describes a treatment of the layers wth 0.5% aqueous ammonium dichromate solution or 2% sodium disulphite solution ($Na_2S_2O_5$) after exposure to light. Our investigations have shown that the production of lightfast, i.e. completely desensitized DIG layers without precipitation of gelatine can be achieved only if development with water is omitted.

It is an object of this invention to provide a method of processing holographically exposed gelatine photolayers, in particular dichromate gelatine photolayers, which results in stable phase holograms which have a low noise level and high refractive efficiency and can be stored.

The process according to the invention differs from the processes described above at every stage except the sensitization stage.

The preliminary hardening which is carried out with a 3 to 30% aqueous formaldehyde solution can be adapted to any type of photogelatine according to the purpose for which it is required. As in the methods described by Lin, Brandes, Francois and Shankoff, sensitization is carried out with a 1 to 10% ammonium dichromate solution. The photographic sensitivities which can be obtained are comparable to those obtained in the above mentioned processes. When exposure is carried out with light of wavelength $\lambda$=514.5 mm, the sensitivities are in the region of 10 to 30 mj/cm$^2$ for achieving the optimum obtainable diffraction efficiencyes (BWG) of the order of 80%. In the process according to this invention, development after exposure does not consist of irrigation but of 1. a desensitization bath containing formaldehyde sulphite and
2. a hardening bath.

Our investigations have shown that neither a bath containing formaldehyde nor a bath containing sodium bisulphite results in a product with the desired advantageous properties. It was only with a strongly basic formaldehyde sulphite bath that phase holograms with a high BWG and low noise level could be produced. The softening of gelatine caused by the basic desensitization bath is reversed by the hardening bath.

After desensitization and hardening, the gelatine can be washed completely clear by irrigation for up to one hour without altering the state of cross-linking of the gelatine. This irrigation is useful for eliminating temporary hardening such as is caused by chromate hardening (Lin). Desensitization and hardening followed by irrigation causes gelatine to undergo cross-linking in such a way that rapid dehydration is not necessary. In the process according to the invention, this rapid dehydration, which causes fogging due to the precipitation of dissolved gelatine molecules, is replaced by slow, suitably adjusted dehydration in two successive baths. The first dehydration bath comprises an aqueous isopropanol solution and the second isopropanol to which formalin has been added.

Subsequent drying in a drying cupboard at temperatures of about 100° C removes isopropanol and residues of formaldehyde from the gelatine and adjusts it to its final state of hardening. Subsequent temporary hardening is then no longer possible.

Holographic two beam phase grids and imagewise phase holograms which have been recorded on DIG layers by the process according to the invention are particularly distinguished from those obtained by known processes in three respects:

1. High lightfastness

The difficulties which occur in the reconstruction of conventional phase holograms, i.e. rehalogenated silver emulsions, due to the formation of photolytic silver and hence deterioration in the noise properties and the BWG are eliminated because the plates are completely desensitized and therefore glass clear. The same difficulties which occur in rehalogenated silver emulsions also occur in incompletely desensitized DIG layers because, when reconstruction is carried out with a high light intensity, part of the light beam is absorbed and causes destruction of the stored information or even of the gelatine itself.

DIG layers processed according to the invention gave the following results in lightfastness tests:

a. A phase hologram was reconstructed with an argon laser beam. The density of energy of the reconstruction beam was 45 W/cm². After 8 hours exposure, the hologram showed no change either in the BWG or in the quality of reproduction.

b. Irradiation of a phase hologram with a mercury maximum pressure vapour lamp (HBO 200, Osram) at a distance of 30 cm produced no change during the test period of 24 hours.

2. High age resistance

Two beam interference grids on DIG were stored in daylight for one year. The temperatures in the investigation room varied from 18° to 35° C. No changes could be detected.

3. No fogging

The quality of a phase hologram is determined not only by its BWG but also by its signal to noise ratio.

Comparison experiments carried out with bleached silver holograms using the method described by H. T. Buschmann (Optik 34, 1971, 240–253) show that good signal to noise ratios can be obtained with DIG layers which have been processed according to the invention. With BWG values for diffuse objects of $\eta = 3 - 25\%$, which can be obtained with the best reversal bleaching processes, the signal to noise ratios are from 20 to 28. With DIG layers which have been processed in accordance with the invention, signal to noise ratios of from 30 to 70 are obtained in this BWG range. For comparison, in amplitude holograms, which have the best signal to noise ratio in silver emulsions, the maximum signal to noise ratio obtained was 32.

The preparation of A) holographic two beam interference grids with extremely high BWG values and B) phase holograms with low noise levels on DIG photoplates using the processing method according to the invention are described below with the aid of two examples. Pure gelatine plate with a layer thickness of 20 μm were used as starting material for producing the DIG photoplates. Resorcinol aldehyde chrome alum was used as hardener.

EXAMPLE A

| | |
|---|---|
| 1) Prehardening | |
| Prehardening bath: | 3% formalin solution in deionised water |
| Processing temperature: | 20° C |
| Processing time: | 5 min |
| The plates are gently agitated. | |

-continued

| | |
|---|---|
| 2) Irrigation | |
| Under running tapwater. | |
| Processing temperature: | 12 – 15° C |
| Processing time: | 5 min |
| 3) Sensitization | |
| Sensitization bath: | 5% ammonium dichromate solution in deionised water. $[(NH_4)_2Cr_2O_7 + n.H_2O]$ chemically pure, cryst. |
| Processing temperature: | 16 – 17° C |
| Processing time: | 25 min |
| The plates must not be moved in the bath. | |
| 4) Drying | |
| a) Preliminary drying | |
| Temperature | 20 – 30° C |
| Time: | 2 h |
| b) Tempering: | |
| Temperature: | 50° C |
| Time | 2 h |

After tempering, the glass side of the plate must be freed from crystalline ammonium dichromate residues.

5. Exposure

The plates were exposed by reflection to symmetric two beam interferences at an incident angle of 20° with an argon laser $\lambda = 514.5$ mm. The impressed localised frequency of the grids was 675 l/mm. The required light exposure energies were 16 mJ/cm².

| | |
|---|---|
| 6) Desensitization | |
| Desensitization bath: | 690 ml of deionised water + 110 g of $Na_2S_2O_5$ (sodium pyrosulphite dry, pa) + 200 ml of 30% H-CHO (Formalin), technically pure |
| Processing temperature: | 17 – 18° C |
| processing time: | 5 min |
| Bath lightly agitated. | |
| 7) Hardening | |
| Hardening bath: | 15% formalin solution |
| Processing temperature: | 17 – 18° C |
| Processing time | 10 min |
| Bath lightly agitated. | |
| 8) Final irrigation | |
| Under running tapwater | |
| Temperature: | 12 – 15° C |
| Time: | 30 min |
| 9) Dehydration | |
| 1st Dehydration bath: | 1 Part of isopropanol + 1 part of deionised water |
| Temperature: | approx. 20° C |
| Time: | 5 min |
| Bath not moved. | |
| 2nd Dehydration bath: | 95 Parts of pure isopropanol + 5 Parts of 30% formalin |
| Processing temperature: | approx. 20° C |
| Processing time: | 10 min |
| Bath not moved. | |
| 10) Drying | |
| a) Preliminary drying: | |
| Temperature: | Room temperature 20 to 30° C |
| Time: | 2 to 3 min |
| This time must be strictly observed. | |
| b) After-drying in the drying cupboard: | |
| Temperature: | 100° C |
| Time: | approx. 10 min. |

The finished grids were found to have the desired high BWG values up to a maximum $\eta = 80\%$ (neglecting the Fresnel losses) at high lightfastness, i.e. the DIG plates were stable even for high energy densities of the reconstruction beam.

EXAMPLE B

1) Preliminary hardening:

-continued

| | |
|---|---|
| Preliminary hardening bath: | 30% formalin (C-HCO) |
| Processing temperatures: | 20° C |
| Processing time: | 10 min |
| Bath lightly agitated | |
| 2) Rinsing | |
| Temperature: | 12 to 15° C |
| Time: | 5 min |
| under running tapwater | |
| 3) Sensitization | |
| Sensitization bath: | 10% ammonium dichromate solution in deionised water $[(NH_4)_2Cr_2O_7 + n.H_2O]$ chemically pure, cryst. |
| Processing temperature: | 16 to 17° C |
| Processing time: | 25 min |
| The plates must not be moved in the sensitization bath. | |
| 4) Drying | |
| a) Preliminary drying: | |
| Temperature: | 20 – 30° C |
| Time: | 2 h |
| b) Tempering | |
| Temperature: | 50° C |
| Time: | 2 h |
| After tempering, the glass side of the plate must be freed from crystalline ammonium dichromate residues. | |

After tempering, the glass side of the plate must be freed from crystalline ammonium dichromate residues.

5. Exposure

To assess the quality of the hologram, holograms of a simple, diffuse object were taken. The object consisted of a matt glass disc with a strip of black adhesive tape 2 mm in width on the matt side. For obtaining holograms with a very low noise level, exposure energies of up to 20 mJ/cm$^2$ were required.

6. Processing after exposure is carried out in the same way as in Example A.

Measurements of noise levels in the phase holograms prosuced in this way show the desired results.

What we claim is:

1. A process for production of light fast phase holograms using a recording material comprised of a light-sensitive material containing hardenable gelatin in which the recording material is preliminarily hardened in a solution of 3–30% aqueous formaldehyde for up to 10 minutes to provide a temporary hardening and then sensitized in a solution of from 1–10% ammonium dichromate holographically exposed whereby cross-linked areas are created in accordance with the interference pattern of the holographic exposure and then the exposed material is developed to provide a phase hologram therein, wherein the improvement comprises the next treatment of the material after exposure is subjecting the hologram to a strongly basic formaldehyde sulfite bath comprising a solution of 3 to 20% by weight of sodium sulphite ($Na_2S_2O_5$) and 5 to 30% by weight of 30% formalin in water for a period to desensitize the ammonium dichromate sensitization of the recording material and then treating the desensitized material with a bath containing formaldehyde to harden the gelatin of the material and then irrigating with running water for 30 minutes to 1 hour to complete desensitization by washing out dichromate without altering the cross-linked condition in the gelatin, after which the exposed and developed material is dehydrated in a first stage with aqueous isopropanol solution and in a second stage with concentrated isopropanol solution to which formaldehyde has been added and dried, said process producing optically clear phase holograms having signal to noise ratios of 30 to 70.

2. A process as claimed in claim 1 in which the treatment in the bath containing strongly basic formaldehyde sulfite solution is for a period of the order of 5 minutes.

3. A process as claimed in claim 1, in which the desensitizing bath consists of a solution of 11% by weight of sodium sulphite ($Na_2S_2O_5$) and 20% by weight of 30% formalin in water.

4. A process as claimed in claim 1 in which the developed recording medium is dehydrated in the first stage in an at least 36% isopropanol bath and in the second stage in anhydrous isopropanol containing 3 to 10% by weight of 30% formalin solution.

5. A process as claimed in claim 4, in which the first dehydrating bath consists of a 50% isopropanol solution and the second dehydrating bath of anhydrous isopropanol to which 5% by weight of a 30% formalin solution has been added.

6. A process as claimed in claim 1 in which the developed and dehydrated recording material is dried at temperatures of about 100° C.

7. A light fast phase hologram as prepared by the process of claim 1.

* * * * *